US011311769B2

(12) United States Patent
Chen

(10) Patent No.: US 11,311,769 B2
(45) Date of Patent: Apr. 26, 2022

(54) AUXILIARY WEIGHT ADJUSTING DEVICE FOR WEIGHT TRAINING EQUIPMENT

(71) Applicant: HEALTHSTREAM TAIWAN INC., Taoyuan (TW)

(72) Inventor: Chun-Ting Chen, Taoyuan (TW)

(73) Assignee: HEALTHSTREAM TAIWAN INC., Taoyuan (TW)

( * ) Notice: Subject to any disclaimer, the term of this patent is extended or adjusted under 35 U.S.C. 154(b) by 2 days.

(21) Appl. No.: 17/027,232

(22) Filed: Sep. 21, 2020

(65) Prior Publication Data

US 2021/0128966 A1 May 6, 2021

(30) Foreign Application Priority Data

Oct. 31, 2019 (TW) ..... 108139536

(51) Int. Cl.
*A63B 21/062* (2006.01)

(52) U.S. Cl.
CPC ..... *A63B 21/063* (2015.10)

(58) Field of Classification Search
CPC ..... A63B 21/063; A63B 21/06; A63B 21/062–0632; A63B 21/00058; A63B 21/00065; A63B 21/00069
See application file for complete search history.

(56) References Cited

U.S. PATENT DOCUMENTS

| | | | | |
|---|---|---|---|---|
| 7,413,532 | B1 * | 8/2008 | Monsrud | A63B 21/0628 482/98 |
| 8,876,674 | B2 * | 11/2014 | Webb | A63B 21/0628 482/99 |
| 9,604,090 | B1 * | 3/2017 | Meyer | A63B 21/0626 |
| 2003/0092542 | A1 * | 5/2003 | Bartholomew | A63B 21/063 482/99 |
| 2006/0217245 | A1 * | 9/2006 | Golesh | A63B 21/0628 482/94 |
| 2016/0074688 | A1 * | 3/2016 | Leipheimer | A63B 21/00069 482/98 |

* cited by examiner

*Primary Examiner* — Joshua Lee
*Assistant Examiner* — Catrina A Letterman
(74) *Attorney, Agent, or Firm* — Muncy, Geissler, Olds & Lowe, P.C.

(57) ABSTRACT

An auxiliary weight adjusting device for weight training equipment includes a selector device and auxiliary weight pieces. The selector member of the selector device is provided with positioning portions and rotatably installed on the main weight device of the weight training equipment. The selector device has positioning members arranged on the selection member in a manner of moving in a horizontal direction and corresponding to the positioning portions. The auxiliary weight pieces are adjacent to the main weight device by moving up and down in the vertical direction and correspond to the positioning members and arranged in a straight line or an array in the horizontal direction. The rotation of the selection member makes the positioning portions drive the positioning members to extend toward the auxiliary weight pieces, so that different numbers of auxiliary weight pieces move with the main weight device.

1 Claim, 7 Drawing Sheets

AUXILIARY WEIGHT ADJUSTING DEVICE FOR WEIGHT TRAINING EQUIPMENT

BACKGROUND OF THE INVENTION

1. Field of the Invention

The present invention relates to weight training equipment, and more particularly to an auxiliary weight adjusting device for weight training equipment.

2. Description of the Related Art

Most of the fitness exercises of weight training use pulling weight pieces to produce weight-bearing training effects. Pulling different numbers of weight pieces can change different weights and achieve enhanced training intensity and variability training effects.

The current weight training equipment will not only set up multiple main weight pieces for athletes to choose different weights in combination, but also match multiple lighter auxiliary weight pieces to move together with the main weight pieces to make the overall weight have fine adjustment effects and various variability. However, the components of the existing auxiliary weight pieces are more complicated and difficult to operate, and the variability of the load is also less.

SUMMARY OF THE INVENTION

The present invention has been accomplished under the circumstances in view. It is the main object of the present invention to provide an auxiliary weight adjusting device for weight training equipment, which has simplified components and easy operation, and the overall load variability is also abundant.

To achieve this and other objects of the present invention, an auxiliary weight adjusting device is designed for use in a weight training equipment. The weight training equipment comprises a main weight device mobile up and down in a vertical direction. The auxiliary weight adjusting device comprises a selector device and a at least one auxiliary weight piece. The selector device comprises a selection member and at least one positioning member. The selection member comprises at least one positioning portion. The selection member is set in the main weight device in a rotating manner. The at least one positioning member is arranged on the selection member in a horizontal direction and corresponding to the at least one positioning portion. The at least one auxiliary weight piece is set adjacent to the main weight device and movable up and down along the vertical direction. The at least one auxiliary weight piece corresponds to the at least one positioning member and is arranged in a straight line or array along the horizontal direction. By rotating the selection member relative to the main weight device, the at least one positioning portion drives the at least one positioning member to extend toward the at least one auxiliary weight piece, so that different numbers of the at least one auxiliary weight piece move up and down synchronously with the main weight device. Thus, the auxiliary weight adjusting device achieves the purpose of invention such as simplified components and convenient operation, and richer variability of overall load.

Preferably, the selection member comprises a disc. The at least one positioning portion is recessed on a surface of the disc, and the recessed depth of each positioning portion is different.

Preferably, the selection member further comprises a guiding inclined surface connected between each two adjacent positioning portions.

Preferably, the selector device comprises a base. The selection member is pivoted at the base. The at least one positioning member is installed on the base in a flexible manner. The at least one positioning member is pushed in the direction of the at least one auxiliary weight piece.

Preferably, the depth of the depression of said at least one positioning portion is gradually increased or decreased according to the direction of rotation of the selection member.

Other and further benefits, advantages and features of the present invention will be understood by reference to the following specification in conjunction with the accompanying drawings, in which like reference characters denote like elements of structure.

DETAILED DESCRIPTION OF THE INVENTION

Hereinafter, the technical content and features of the present invention will be described in detail by enumerating preferred embodiments with drawings. The auxiliary weight adjusting device of weight training equipment provided by the present invention can be widely used in various fitness equipment with weight training boxes. Those skilled in the art can understand that the explanatory terms of this embodiment belong to the upper-level description that does not limit the application field. For example, the material or shape terms include but are not limited to the material or shape specified by the description content, and the position terms include but are not limited to setting, proximity, connect, or adjacency. The term "one" for the quantity of each component includes one and more than one component quantity. The directional adjectives mentioned in the content of this specification, such as "upper", "lower", "inner", "outer", "top", "bottom", etc. are only exemplary descriptions based on the normal direction of use and are not intended to limit the scope of claims.

Figure 1:
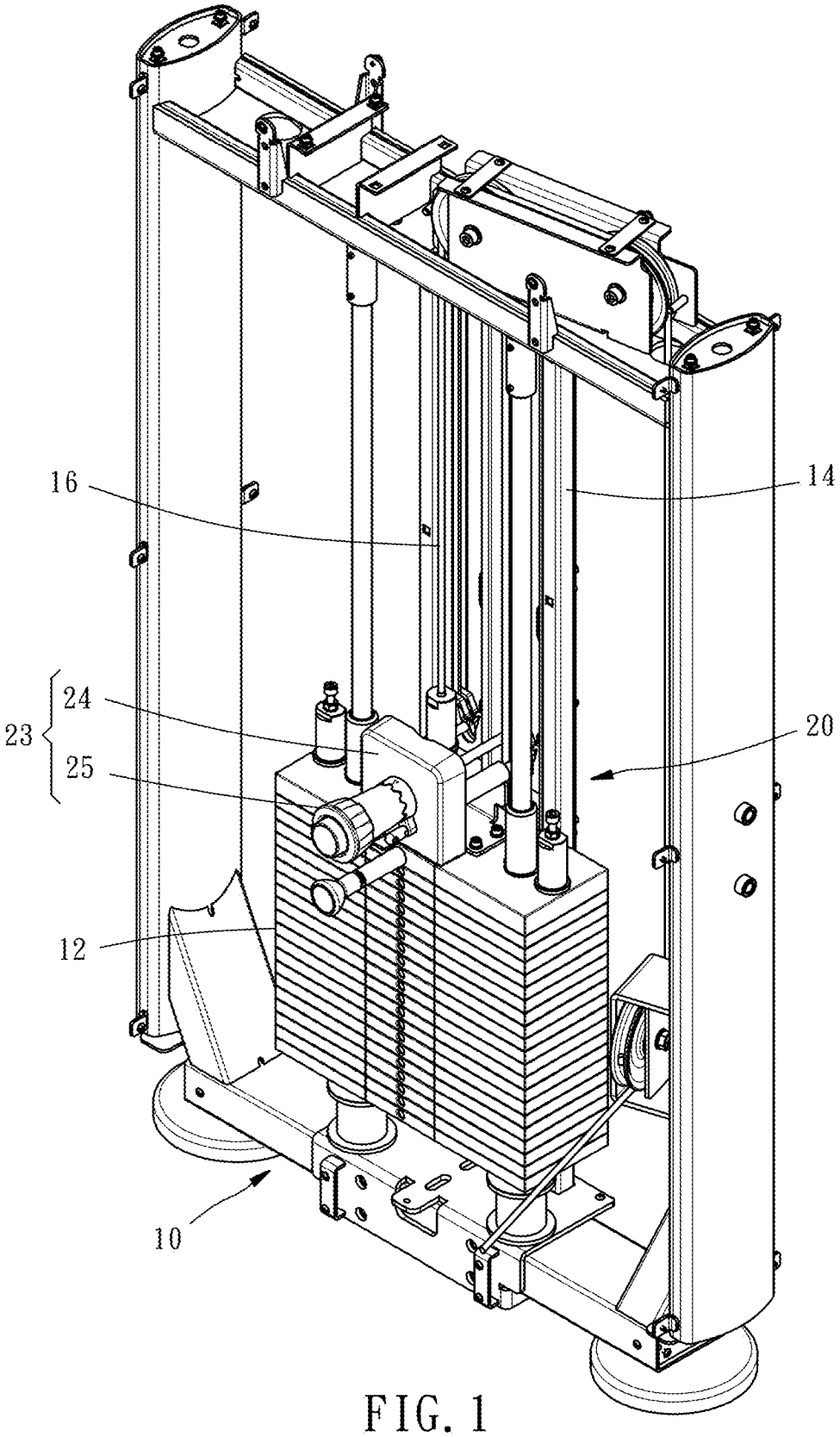
FIG. 1 is an oblique top elevational view of an auxiliary weight adjusting device for weight training equipment in accordance with the present invention.
Figure 2:
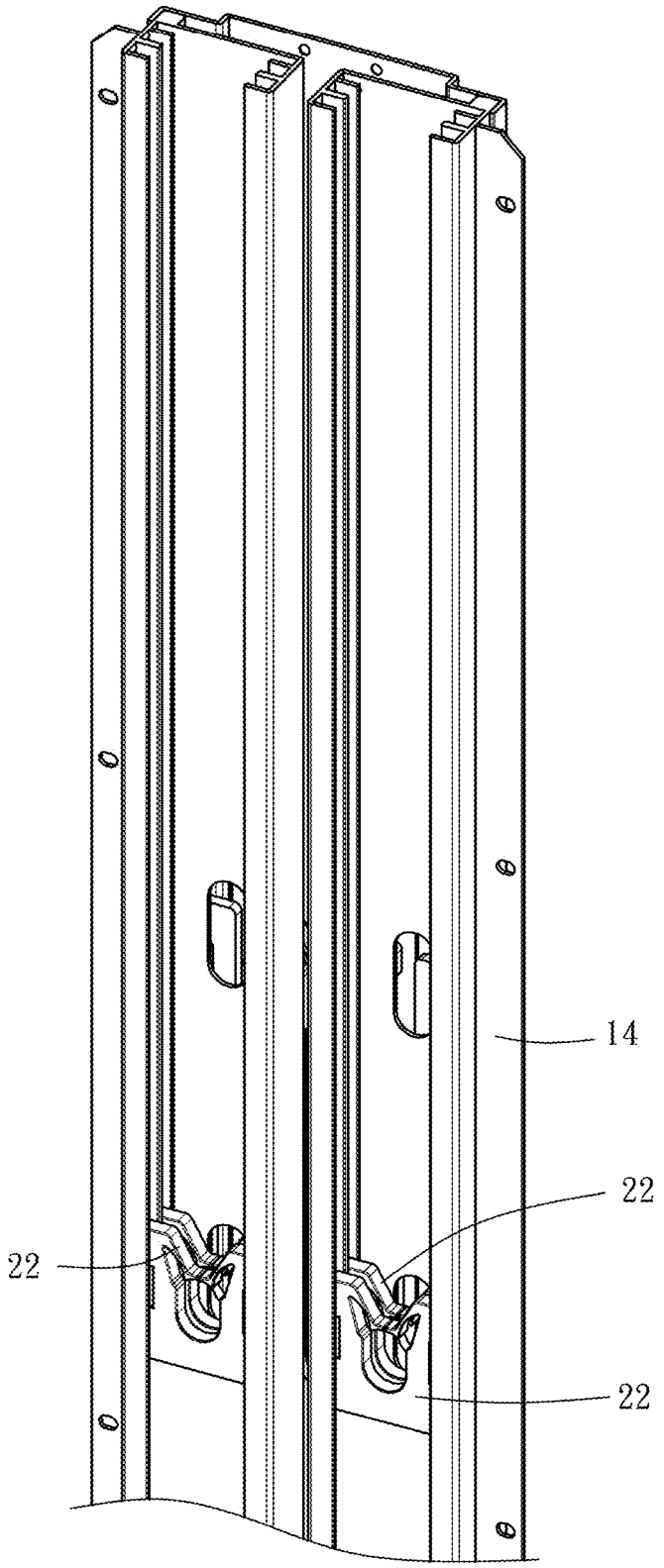
FIG. 2 is an elevational view, in an enlarged scale, of a part of the auxiliary weight adjusting device for weight training equipment in accordance with the present invention.
Figure 3:
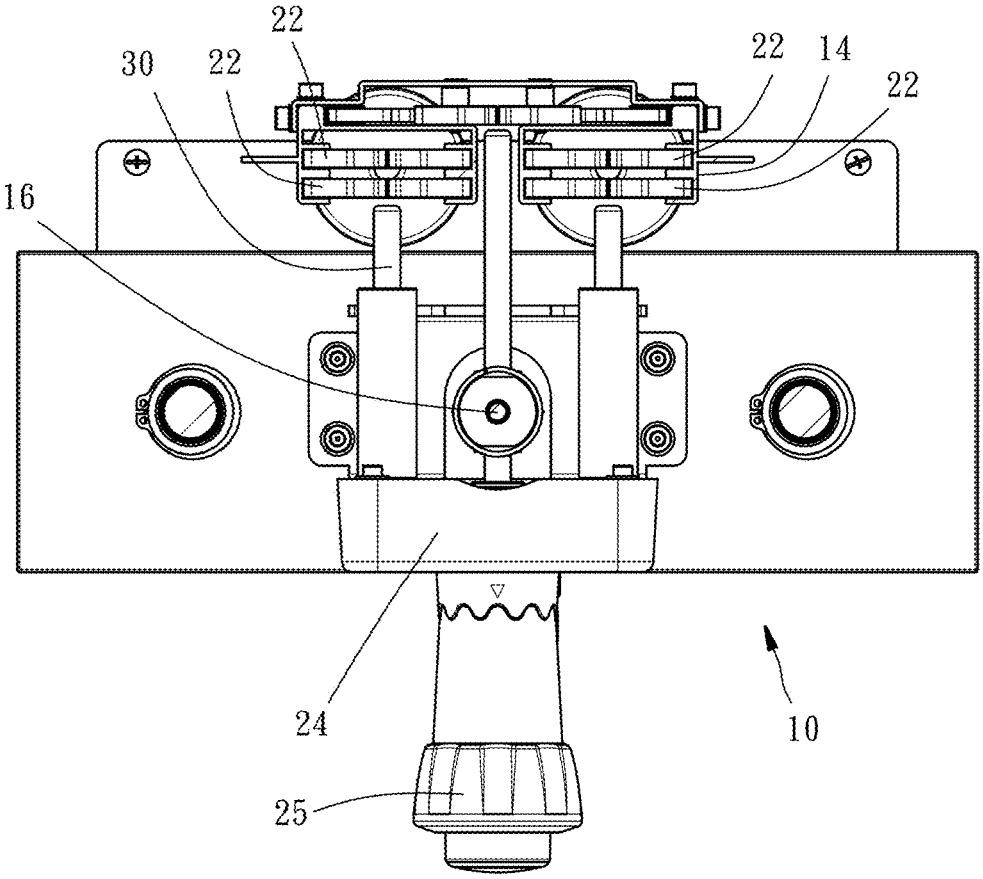
FIG. 3 is a top view of a part of the auxiliary weight adjusting device for weight training equipment in accordance with the present invention.
Figure 4:
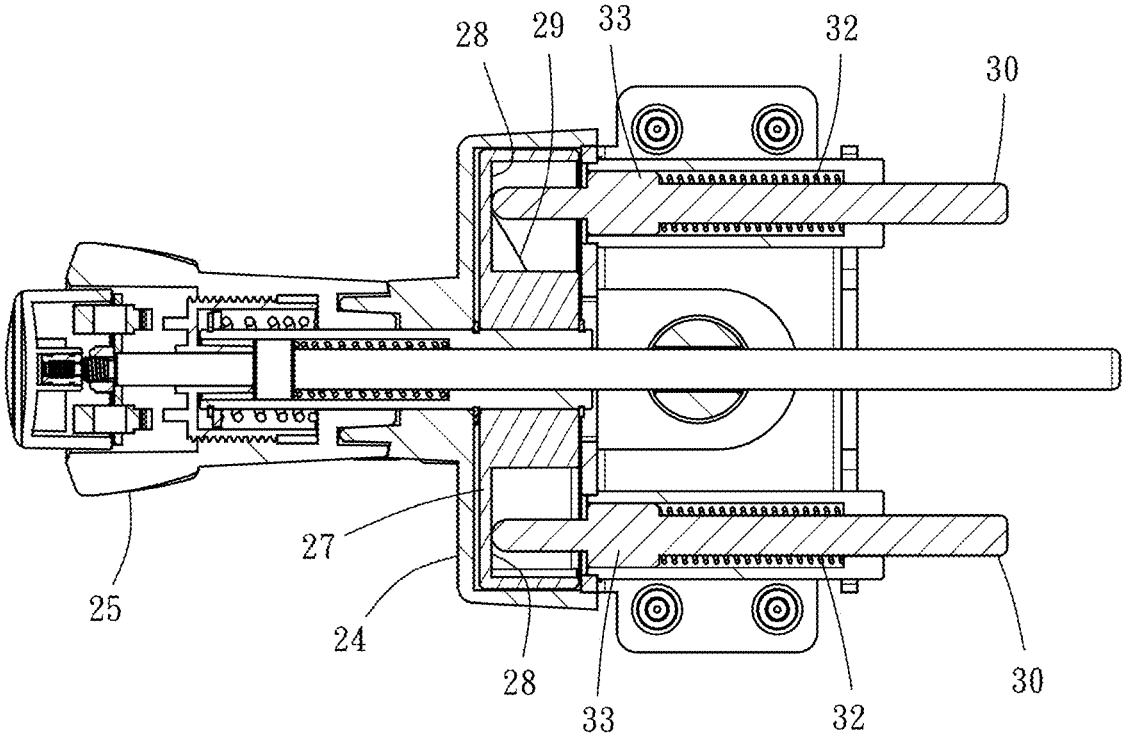
FIG. 4 is a sectional view of the selector device.

Referring to FIGS. 1-4, a preferred embodiment of the present invention takes a weight training equipment with a weight training box as an example. The weight training box has a main weight device 10. The main weight device 10 includes a plurality of main weight pieces 12 stacked on each other and is provided with a vertically extending guide rail 14. The main weight pieces 12 can move up and down with the drive of a steel cable 16.

The auxiliary weight adjusting device 20 provided by the present invention comprises at least one auxiliary weight piece 22 and a selector device 23. The number of the at least one auxiliary weight piece 22 is adjusted according to the product demand and load design of the weight training equipment. In this preferred embodiment, the number of the at least one auxiliary weight piece 22 is 4. Each auxiliary weight piece 22 is hollow as an example. The auxiliary weight pieces 22 are installed inside the guide rail 14 so that the auxiliary weight pieces 22 are adjacent to the main weight device 10 and move up and down in the vertical direction, The auxiliary weight pieces 22 are arranged in an array along the horizontal direction, of course, they can also be arranged in a straight line along the horizontal direction.

Figure 5:
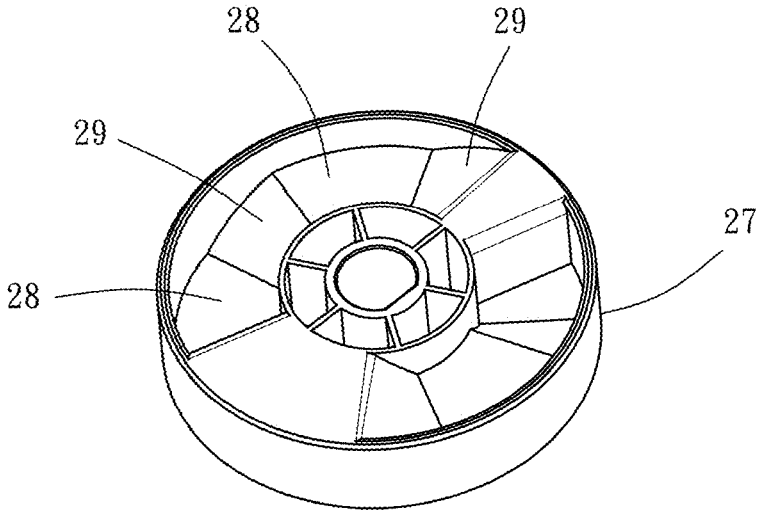
FIG. 5 is an elevational view of the disc of the selection member.
Figure 6:
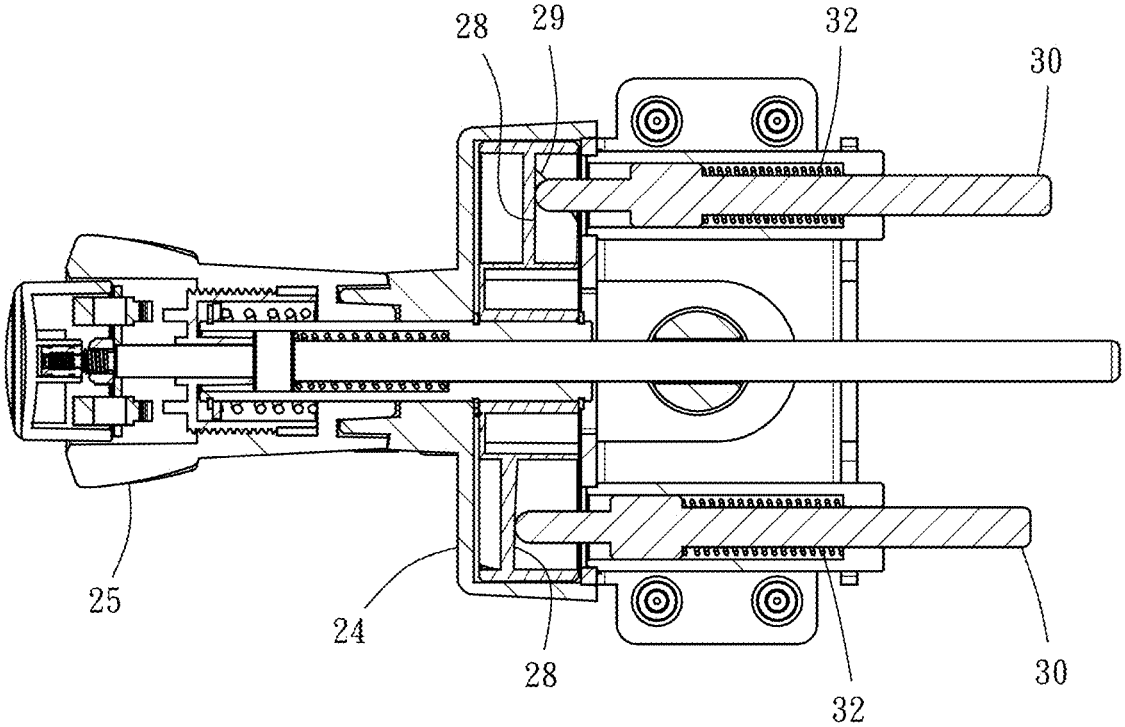
FIG. 6 similar to FIG. 4, illustrating the positioning members extended in different lengths.

Referring to FIGS. 3-6, the selector device 23 comprises a base 24, a selection member 25, and at least one positioning member 30. The base 24 can be a shell or a combination of multiple components. The base 24 is set on the top of the main weight device 10. The selection member 25 is pivoted at the base 24. In this preferred embodiment, the selection member 25 takes the knob as an example. The selection member 25 has a disc 27, and the disc 27 is provided with at least one positioning portion 28. In this preferred embodiment, the positioning portion 28 is a number of recesses recessed on the surface of the disc 27 as an example. The positioning portions 28 are arranged on the surface of the disc 27, the depth of the depression of each positioning portion 28 is different, and there is a guiding inclined surface 29 between each two adjacent positioning portions 28.

In this preferred embodiment, the depth of the depression of the positioning portions 28 is gradually increased or decreased according to the direction of rotation of the selection member 25 to make the operation of adjusting the auxiliary weight easier.

In this preferred embodiment, the positioning member 30 is a rod member, and the number of the at least one positioning member 30 is 2 as an example. Each positioning member 30 passes through base 24 in a movable manner in the horizontal direction. Each positioning member 30 has one end thereof abutted against one respective positioning portion 28 of the selection member 25 and an opposite end thereof extending toward auxiliary weight piece 22. Each positioning member 30 is set on the base 24 in a flexible way.

In this preferred embodiment, a spring 32 is set between each positioning member 30 and the base 24, so that the spring 32 has two opposite ends thereof respectively stopped against a flange 33 of the respective positioning member 30 and an inside of the base 24, letting the positioning member 30 be pushed toward the auxiliary weight piece 22 by the elastic force of the spring 32.

By the above composition components of the present invention, when the selection member 25 rotates together with the disc 27, the positioning members 30 directly against the positioning portions 28 can extend different lengths toward the auxiliary weight pieces 22 in accordance with the different recess depths of the positioning portions 28.

Figure 7:
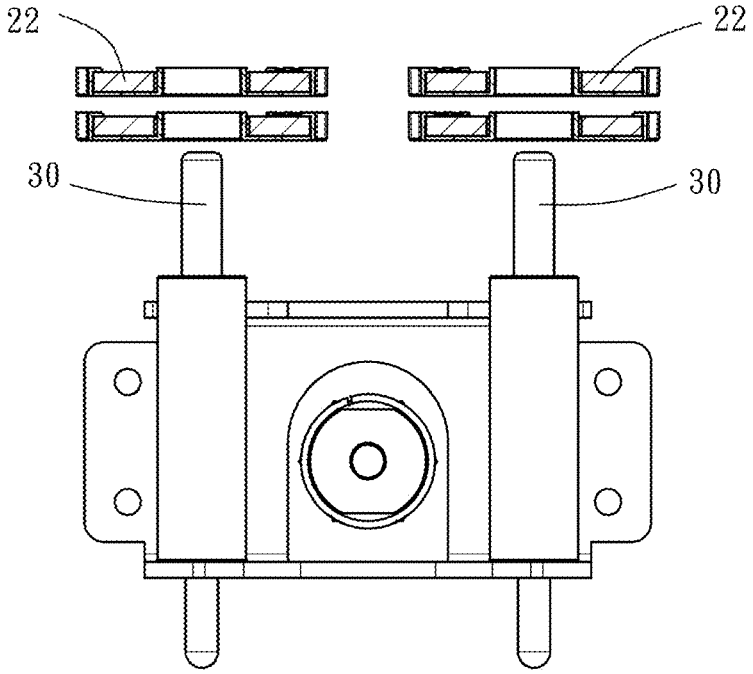
FIGS. 7-10 are schematic drawings of the present invention, illustrating the positioning members extended to different numbers of auxiliary weight pieces.
Figure 8:
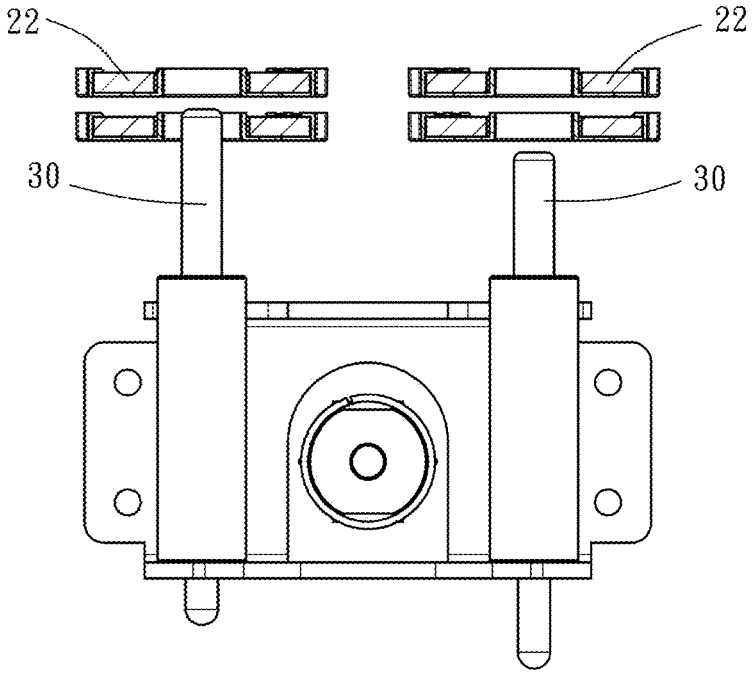
Figure 9:
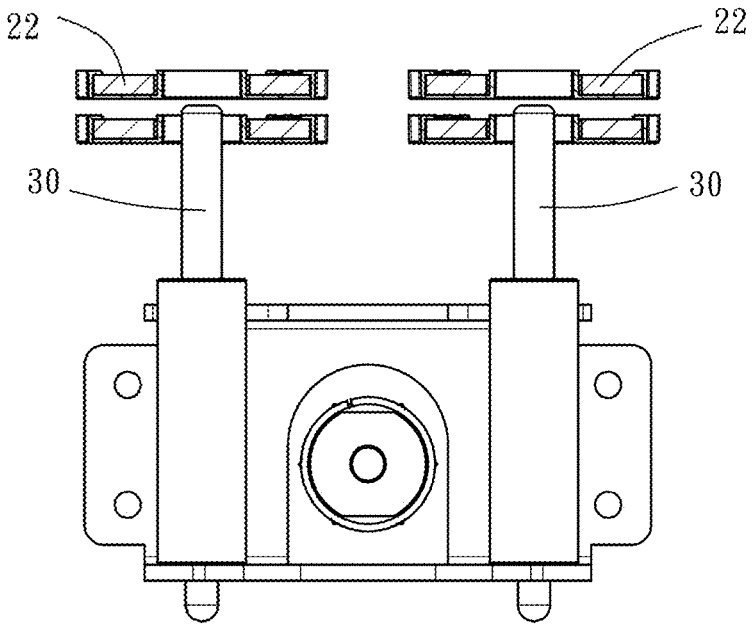
Figure 10:
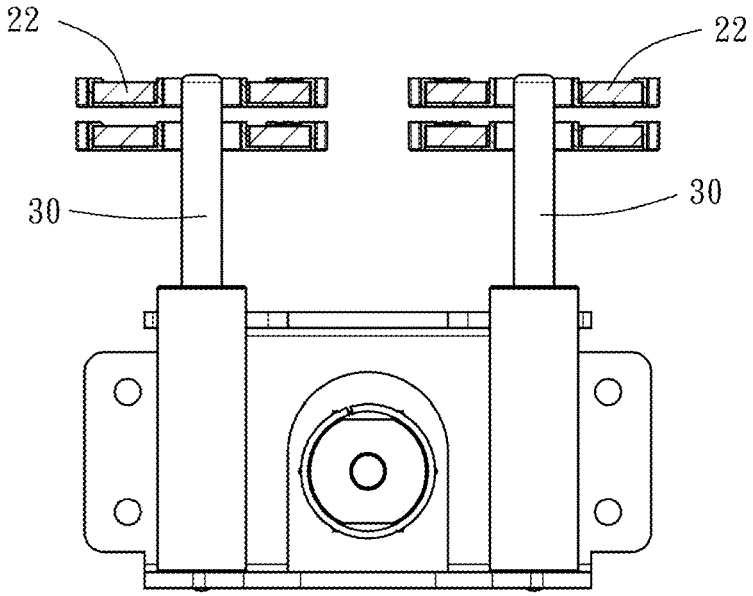

As shown in FIGS. 7-10, when the positioning members 30 have different extension lengths, the positioning members 30 can pass through the center of different numbers of auxiliary weight pieces 22. When the main weight device 10 moves up and down, each positioning member 30 can simultaneously drive the respective auxiliary weight piece 22 to move up and down.

Since the auxiliary weight pieces 22 are arranged in a straight line or matrix form behind the main weight device 10 in the horizontal direction, the composition volume of the overall weight adjusting device is relatively simple. Furthermore, the selection member 25 can change the extension length of the positioning members 30 to drive a different number of auxiliary weight pieces 22.

Since a guiding inclined surface 29 is provided between each two adjacent positioning portions 28 of the disc 27, when the selection member 25 is rotated, the positioning members 30 can easily resist different positioning portions 28 along the guiding inclined surfaces 29, thus making the operation mode of the present invention simpler and lighter rotating torque. If you want to increase the overall weight-bearing variability and achieve more segmented weight-bearing effects, you only need to increase the number and depth of the positioning portions 28 of the selection member 25, and you can achieve the training effect of increasing the subtle weight-bearing changes.

What is claimed is:

1. An auxiliary weight adjusting device for use in a weight training equipment, said weight training equipment comprising a main weight device mobile up and down in a vertical direction, said auxiliary weight adjusting device comprising:

a selector device comprising a selection member and at least one positioning member, said selection member comprising a plurality of positioning portions, said selection member being set in said main weight device in a rotating manner, said at least one positioning member being arranged on said selection member in a horizontal direction and corresponding to said plurality of positioning portions; and at least one auxiliary weight piece set adjacent to said main weight device and movable up and down along said vertical direction, said at least one auxiliary weight piece corresponding to said at least one positioning member, and being arranged in a straight line or array along said horizontal direction;

wherein by rotating said selection member relative to said main weight device, said plurality of positioning portions drive said at least one positioning member to extend toward said at least one auxiliary weight piece, so that different numbers of said at least one auxiliary weight piece move up and down synchronously with said main weight device;

wherein said selection member comprises a disc; said plurality of positioning portions are recessed on a surface of said disc, and the recessed depth of each of said plurality of positioning portions is different;

wherein said selection member further comprises a guiding inclined surface connected between adjacent two of said plurality of positioning portions;

wherein said selector device comprises a base; said selection member is pivoted at said base; said at least one positioning member is installed on said base in a flexible manner; said at least one positioning member is pushed in the direction of said at least one auxiliary weight piece;

wherein a depth of the depression of said plurality of positioning portions is gradually increased or decreased according to the direction of rotation of said selection member.

* * * * *